US006540119B1

(12) United States Patent
Bensussan et al.

(10) Patent No.: US 6,540,119 B1
(45) Date of Patent: Apr. 1, 2003

(54) SPRAY BOTTLE HOLDER ASSEMBLY

(75) Inventors: Bernard Leon Bensussan, Monroe, CT (US); Ronald Callanan, Seymour, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 0 days.

(21) Appl. No.: 09/772,437

(22) Filed: Jan. 30, 2001

(51) Int. Cl.[7] ..... B67D 5/60

(52) U.S. Cl. ..... 222/464.3; 222/192; 222/381; 222/383.3

(58) Field of Search ..... 222/192, 381, 222/382, 464.1, 464.3, 383.3

(56) References Cited

U.S. PATENT DOCUMENTS

| | | | | | |
|---|---|---|---|---|---|
| 2,169,080 | A | | 8/1939 | Clark | 224/5 |
| 3,061,202 | A | * | 10/1962 | Tyler | 239/333 |
| 3,463,536 | A | | 8/1969 | Updegraff et al. | 294/31.2 |
| 4,120,434 | A | | 10/1978 | Hewes | 224/5 V |
| 4,366,921 | A | * | 1/1983 | Kirk | 222/153 |
| 4,407,454 | A | * | 10/1983 | Massey | 239/154 |
| 4,479,593 | A | * | 10/1984 | Bundschuh | 222/321 |
| 4,498,613 | A | | 2/1985 | Donahue et al. | 224/251 |
| 4,526,298 | A | * | 7/1985 | Boxer | 222/130 |
| 5,167,354 | A | | 12/1992 | Cohanfard | 224/148 |
| 5,203,481 | A | | 4/1993 | Dobbins et al. | 224/148 |
| 5,215,227 | A | * | 6/1993 | Farner | 222/175 |
| 5,301,857 | A | | 4/1994 | Green | 224/148 |
| 5,302,302 | A | * | 4/1994 | Shelley | 224/148 |
| 5,489,078 | A | | 2/1996 | Risley | 248/231.81 |
| 5,573,152 | A | | 11/1996 | Arnold | 224/148.4 |
| 5,676,285 | A | | 10/1997 | Vinarsky | 224/148.1 |
| 5,718,383 | A | * | 2/1998 | Smith | 239/272 |
| D404,613 | S | | 1/1999 | Walker | D9/344 |
| 5,941,434 | A | * | 8/1999 | Green | 224/250 |
| 5,960,973 | A | * | 10/1999 | Markson | 215/386 |

* cited by examiner

*Primary Examiner*—Henry C. Yuen
*Assistant Examiner*—Melvin A Cartagena
(74) *Attorney, Agent, or Firm*—Ohlandt, Greeley, Ruggiero & Perle, LLP; George W. Rauchfuss, Jr.

(57) ABSTRACT

The present invention provides an assembly for use with spray bottles. Spray bottles include a container with an open end removably sealed by a pump. The pump has a removable dip tube. The assembly has a bottle support including a fastener and a container coupling. The assembly also has a pump extender adapted to be operatively coupled to the pump with its dip tube removed. Moreover, the assembly has an extension conduit in fluid communication with the pump extender. The fastener is adapted to secure the bottle support to the cloths of a user. The container coupling is adapted to be removably sealed to the open end of the container. The container coupling is adapted to operatively couple the dip tube, removed from the pump, with the extension conduit.

13 Claims, 14 Drawing Sheets

SPRAY BOTTLE HOLDER ASSEMBLY

BACKGROUND OF THE INVENTION

1. Field of the Invention

The present invention relates to the field of spray bottles. More particularly, the present invention relates to an apparatus that allows a user to use a spray bottle while carrying the bottle on their belt. The present invention also provides storage for other tools commonly used with such spray bottles.

2. Description of the Prior Art

It has long been recognized that there is a need for cleaning persons to carry a container of cleaning solution on their body, thus freeing one or both hands. For example, U.S. Pat. No. 2,169,080 to Clark was directed to a harness for pails, which allowed the user to carry a pail of cleaning solution on their body.

Even in today's world of pre-filled containers of cleaning solutions, the problem for the cleaning person remains the same. Namely, carrying the container with them and using the container while maintaining one or both of their hands free. For example, U.S. Pat. No. 5,992,715 to Habibi is directed to a spray bottle lanyard. Habibi provided a spring clip that securely grasps the seal ring at the top of a conventional pressurized spray bottle.

In the present day, cleaners must carry spray bottles of cleaning solution with them when they clean. While cleaning, the user holds a spray bottle in one hand and a rag in the other. This method is very widely used but it has several problems: (1) when using a full bottle, the cleaner must hold its whole weight at all time, creating undue fatigue and strain; (2) if a specific surface requires the use of a special cleaning solution, the cleaner must go back to the cart or the supply closet to get that bottle; and (3) while cleaning an area, cleaners cannot do anything else, such as simple maintenance tasks because both hands are busy. Accordingly, the prior art does not provide a solution to such problems when carrying and using a spray bottle having a trigger or spray actuator.

SUMMARY OF THE INVENTION

Accordingly, the present invention provides an improved device for carrying and using a spray bottle having a trigger or spray actuator.

It is an object of the present invention to provide a spray bottle support for use with spray bottles. Spray bottles include a container with an open end removably sealed by a pump. The pump includes a removable dip tube. The spray bottle support comprises a fastener for securing the spray bottle support to a user; a coupling adapted to sealably receive the open end of the container; an adapter for sealably receiving the dip tube of the pump within the coupling; and an extension conduit. The extension conduit is in fluid communication with the adapter and in fluid communication with a free end. The free end is adapted to be operatively connected to the pump.

It is another object of the present invention to provide an assembly for use with such spray bottles. The assembly has a bottle support including a fastener and a container coupling. The assembly also has a pump extender adapted to be operatively coupled to the pump having its dip tube removed. Moreover, the assembly has an extension conduit in fluid communication with the pump extender. The fastener is adapted to secure the bottle support to the cloths of a user. The container coupling is adapted to be removably sealed to the open end of the container. The container coupling is adapted to operatively couple the dip tube, removed from the pump, with the extension conduit.

It is yet another object of the present invention to provide a method of converting a spray bottle into an easy to use assembly. The spray bottle includes a container with an open end removably sealed to a pump having a removable dip tube. The method includes the steps of: (1) removing the pump from the container; (2) removing the dip tube from the pump; (3) operatively connecting a pump extender to the pump; (4) connecting the dip tube to a container coupling of a bottle support; and (5) connecting the container coupling to the open end of the container. The pump extender is in fluid communication with an extension conduit that is in turn in fluid communication with the container coupling. Accordingly, connecting the container coupling to the open end of the container operatively couples the dip tube with the pump via the extension conduit.

It is another object of the present invention to provide a method of converting a spray bottle into an easy to use assembly that enables the user to spray vertically or substantially vertically.

It is another object of the present invention to provide a method of converting a spray bottle into an easy to use assembly that enables the user to spray in hard to reach places where standard bottles are unable to reach.

DETAIL DESCRIPTION OF THE INVENTION

Figure 1:
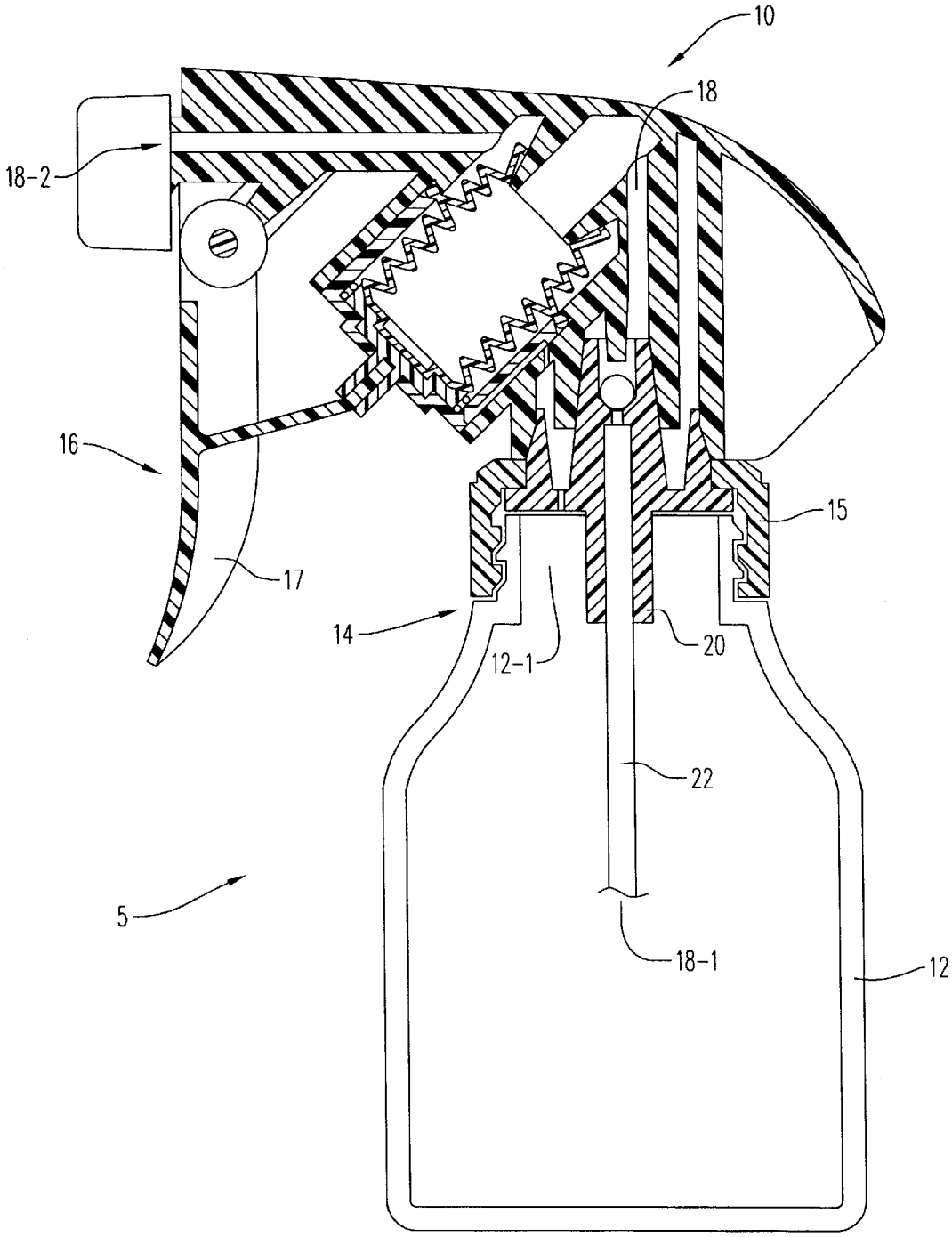
FIG. 1 (PRIOR ART)
FIG. 1 is a cross sectional view of a prior art manually operated spray pump or trigger pump.

Referring to the figures and particularly to FIG. 1, a prior art manually operated spray pump or trigger pump numeral 10 is shown. Such manually operated spray pump or trigger pumps ("pump") are well known in the art. Prior art pumps 10 are adapted for use with a container 12 having an open end 12-1 to form a spray bottle 5. Container 12 is used to hold a liquid, such as a cleaning solution.

The elements of pump 10 necessary for the understanding of the present invention are described herein. Pump 10 includes a connector 14, an actuator 16 and a conduit 18. Connector 14 is adapted to removably seal pump 10 to open end 12-1 of container 12. Actuator 16 adapted to selectively pump liquid from container 12 through conduit 18. In the embodiment of FIG. 1, connector 14 is an internally threaded cap 15 and actuator 16 is a trigger 17. Conduit 18 has an input end 18-1 within container and an output end 18-2 for outputting the liquid.

In use, pump 10 is removably coupled to the open end of container 12 via connector 14 such that input end 18-1 extends into the container and at least partially below the level of the fluid contained within the container. Accordingly, conduit 18 is adapted to allow liquid to pass into conduit 18 through input end 18-1 and emit from container 12 through output 18-2 when pump 10 is actuated via actuator 16.

In the preferred embodiment of pump 10, pump 10 includes an adapter 20 with a dip tube 22 removable sealed therein. In this embodiment, the free end of dip tube 22 forms input 18-1. In use, pump 10 is removable coupled to the open end of container 12 via connector 14 and dip tube 22 is removably sealed within adapter 20 such that the dip tube extends into the container and at least partially below the level of the fluid contained within the container. Preferably, dip tube 22 extends substantially to the bottom of container 12, enabling pump 10 to extract substantially all of the liquid from the container.

Most commercially available spray bottles 5 include such a pump 10, dip tube 22 and a container 12 and can be bought right off the shelf from grocery stores, commercial cleaning supply stores or any other cleaning supply distribution channels, either assembled or each part separately.

Figure 2:
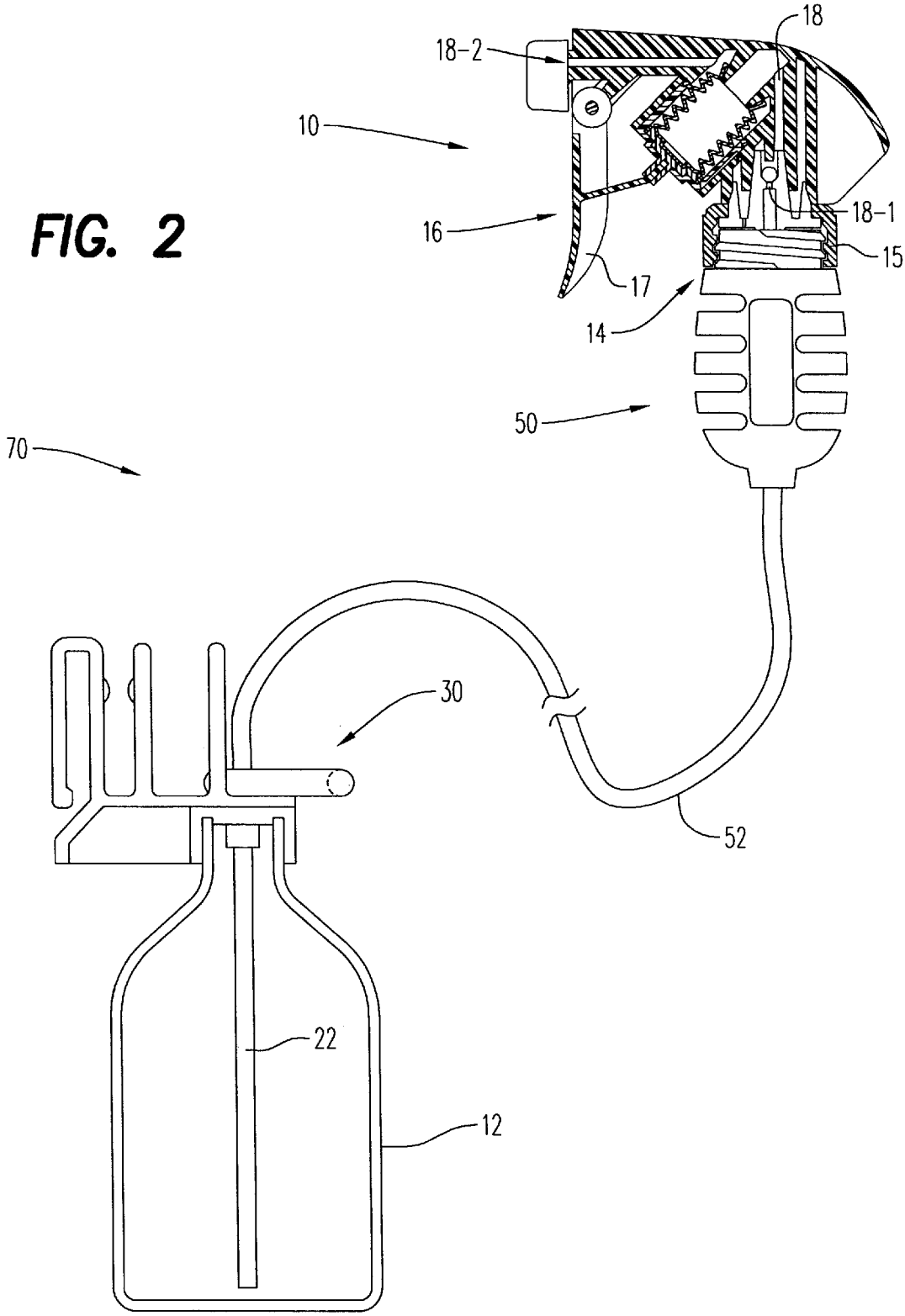
FIG. 2 is a sectional view showing the assembly of the present invention.

The present invention provides an assembly 70, shown in FIG. 2, adapted for use with commercial spray bottles 5. Accordingly, assembly 70 removably couples pump 10, dip tube 22 and container 12 of spray bottle 5 with a bottle support 30, a extension conduit 52 and a pump extender 50 to provide an easy to use device for carrying and using the container while keeping one or both hands free. In a preferred embodiment assembly 70 is a unitary or one piece device.

Figure 3A:
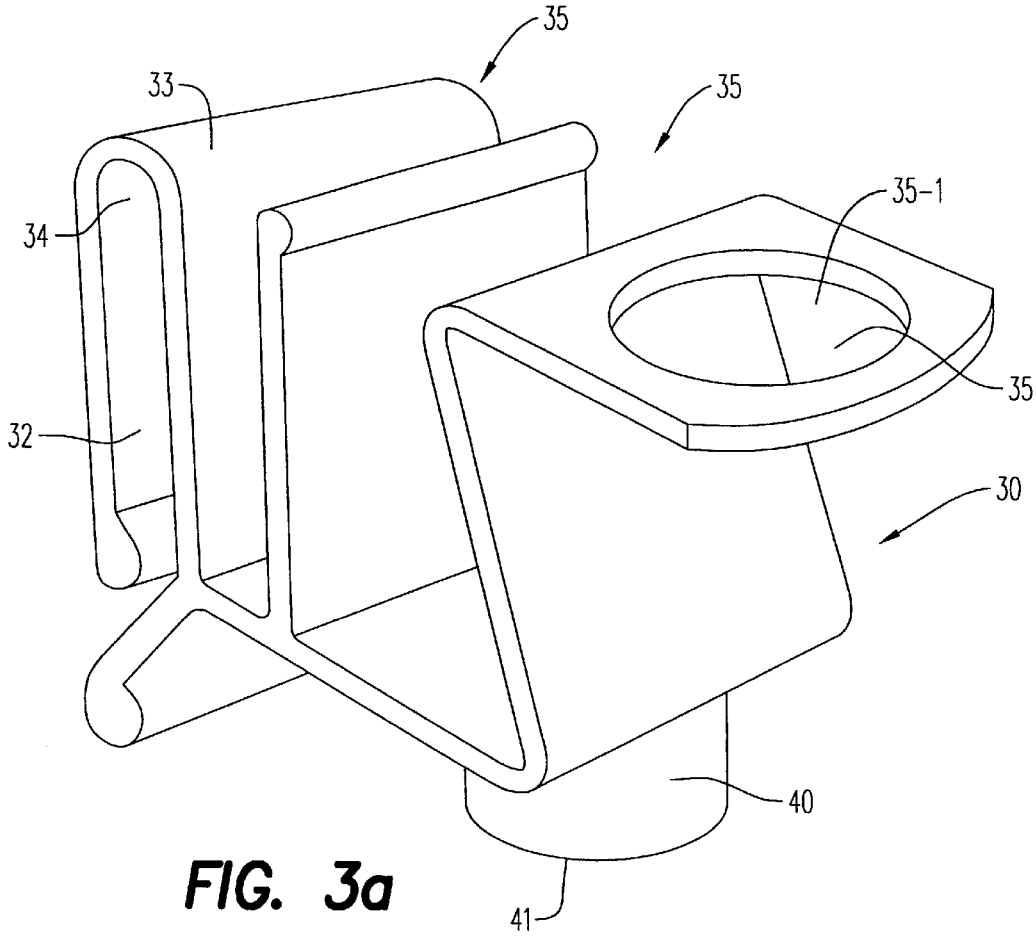
FIG. 3*a* is a perspective view of a first embodiment of the support of the present invention.
Figure 3B:
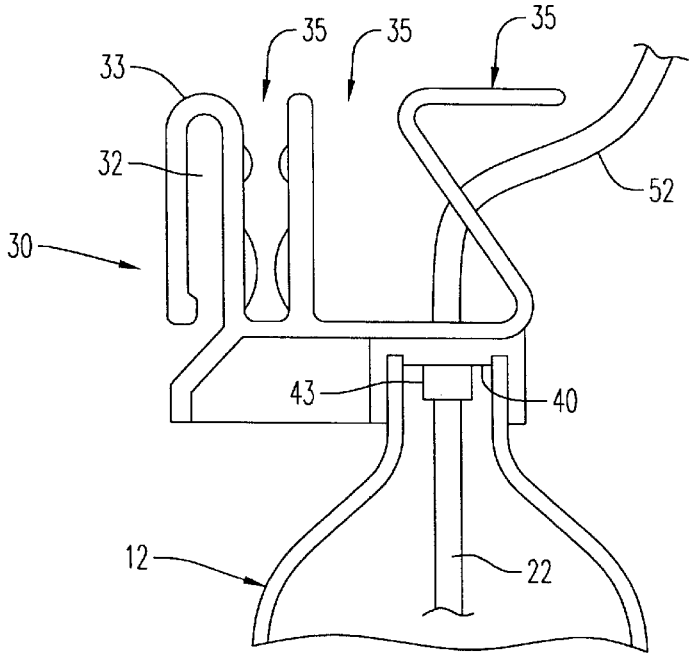
FIG. 3*b* is a side view of the support of FIG. 3*a* removably coupled to the container.

Support 30, shown in FIGS. 3*a* and 3*b*, includes a fastener 32 and a container coupling 40.

Fastener 32 connects support 30 to a user. For example, in a preferred embodiment fastener 32 is a clip 33 for securing support 30 to a user's clothing. In the embodiment of FIG. 3, clip 33 is a belt clip that preferably includes a resiliently biasing portion 34 to resiliently compress the belt of a user within clip 33.

Figure 4:
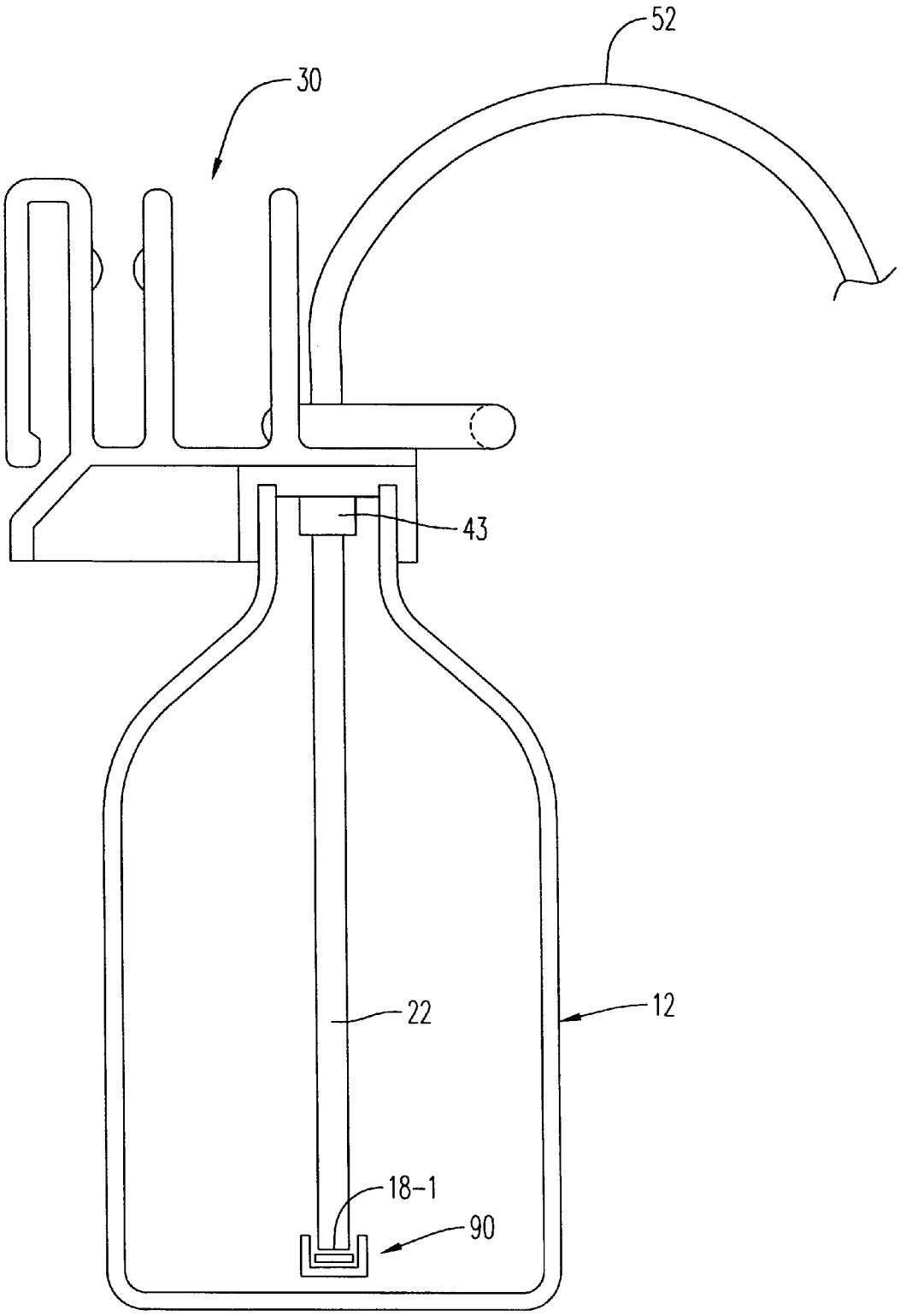
FIG. 4 is a sectional view showing the support removably coupled to the container.

Container coupling 40 is configured to mimic connector 14 of pump 10. In use, connector 14 is used to uncouple open end 12-1 of container 12 from pump 10 and then dip tube 22 is removed from adapter 20. In the embodiment described above in which connector 14 is an internally threaded cap 15, coupling 40 is an internally threaded cap 41. Coupling 40 includes an adapter 43 configured to mimic adapter 20 of pump 10. Thus, as shown in FIG. 4, adapter 43 is adapted to removably seal dip tube 22 to coupling 40, which is adapted to removably seal open end 12-1 of container 12 to support 30. Adapter 43 places dip tube 22 within container 12 in fluid communication with an extension conduit 52, described below. In this embodiment, the free end of dip tube 22 forms input 18-1 and input 18-1 extends into container 12 as described above. Thus, adapter 43 places extension conduit 52 in fluid communication with the liquid within container 12.

Also shown in FIG. 4, an anti-siphon device 90 is provided on the free end of dip tube 22 sealing input 18-1. Anti-siphon device 90 is adapted to allow the flow of liquid from container 12 into input 18-1 of dip tube 22, yet restrict the flow of liquid back into the container from the dip tube. Thus, anti-siphon device 90 is adapted to keep pump 10 primed with liquid to reduce stress on the user.

Figure 15B:
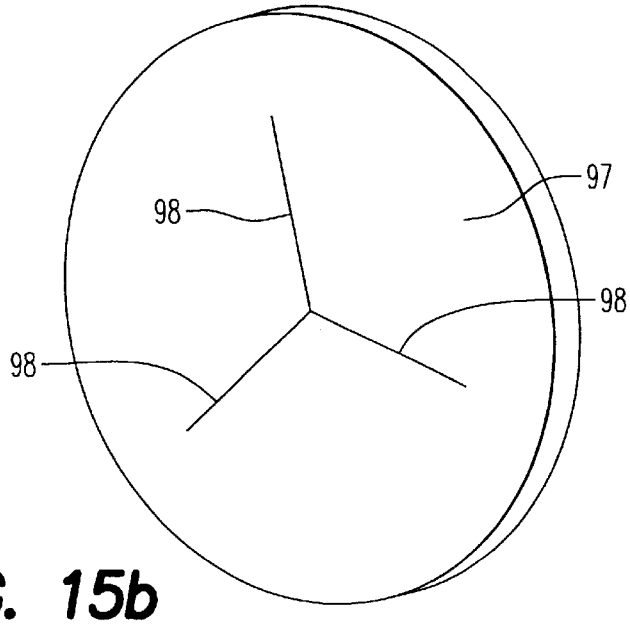
FIG. 15*b* is a perspective view of a one-way valve of the anti-siphon device of FIG. 15*a*.
Figure 15A:
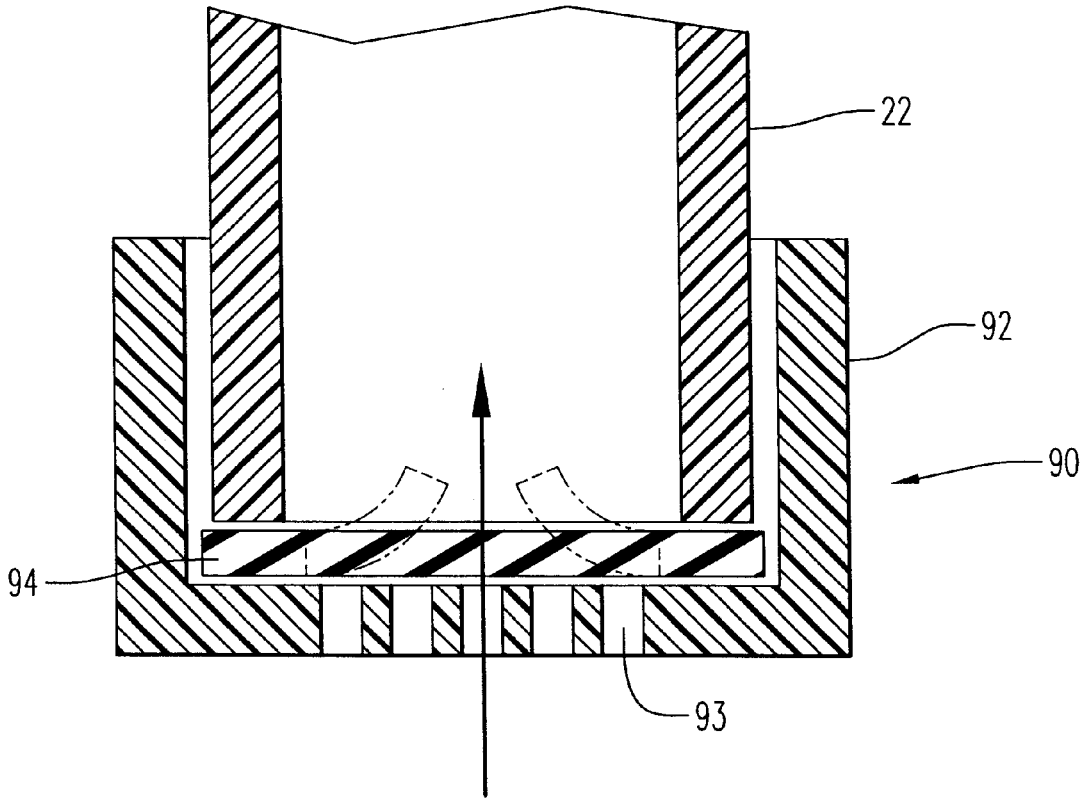
FIG. 15*a* is a sectional view of an anti-siphon device of the present invention.

A preferred embodiment of anti-siphon device 90 is shown in FIGS. 15*a* and 15*b*. Anti-siphon device 90 preferably includes a strainer 92 having holes 93 and a self-closing one-way valve 95. Strainer 92 is sealed about open end 18-1 of dip tube 22 such that one-way valve 95 is in fluid communication with the open end via holes 93. Strainer 92 prevents foreign matter from entering dip tube 22.

One-way valve 95 is normally closed as shown in solid lines in FIG. 15*a*. However, when fluid is drawn by pump 10 through anti-siphon device 90, one-way valve 95 opens as shown in dotted lines to allow fluid to flow from container 12. Removal of pressure on one-way valve 95 from pump 10 causes the one-way valve to close. Strainer 92 supports one-way valve 95, in the normally closed position, such that the one-way valve can not open in a reverse direction.

A preferred embodiment of self-closing one-way valve 95 is shown in FIG. 15*b*. Self-closing one-way valve 95 is an elastic member 97 having at least one slit 98. Preferably, slit 98 includes three slits formed in a star-like pattern. It should be understood that other self-closing one-way valves 95, such as, but not limited to duck-bill or flap valves, that allow the flow of liquid from container 12 into input 18-1 of dip tube 22, yet restrict the flow of liquid back into the container from the dip tube are within the scope of the present invention.

Figure 5:
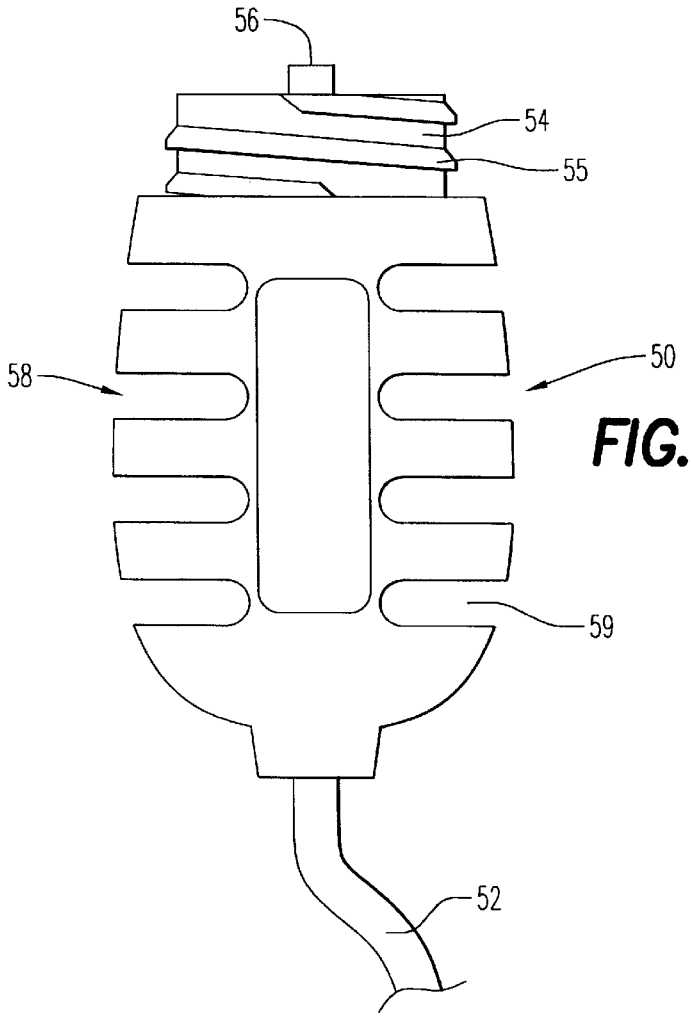
FIG. 5 is a side view of a first embodiment of the pump extender of the present invention.
Figure 6:
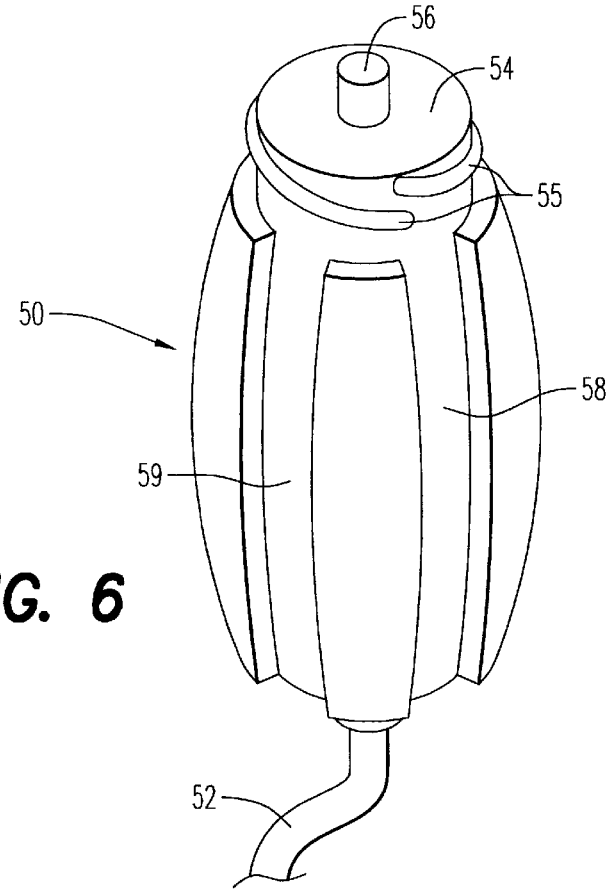
FIG. 6 is a perspective view of a second embodiment of the pump extender of the present invention.
Figure 7:
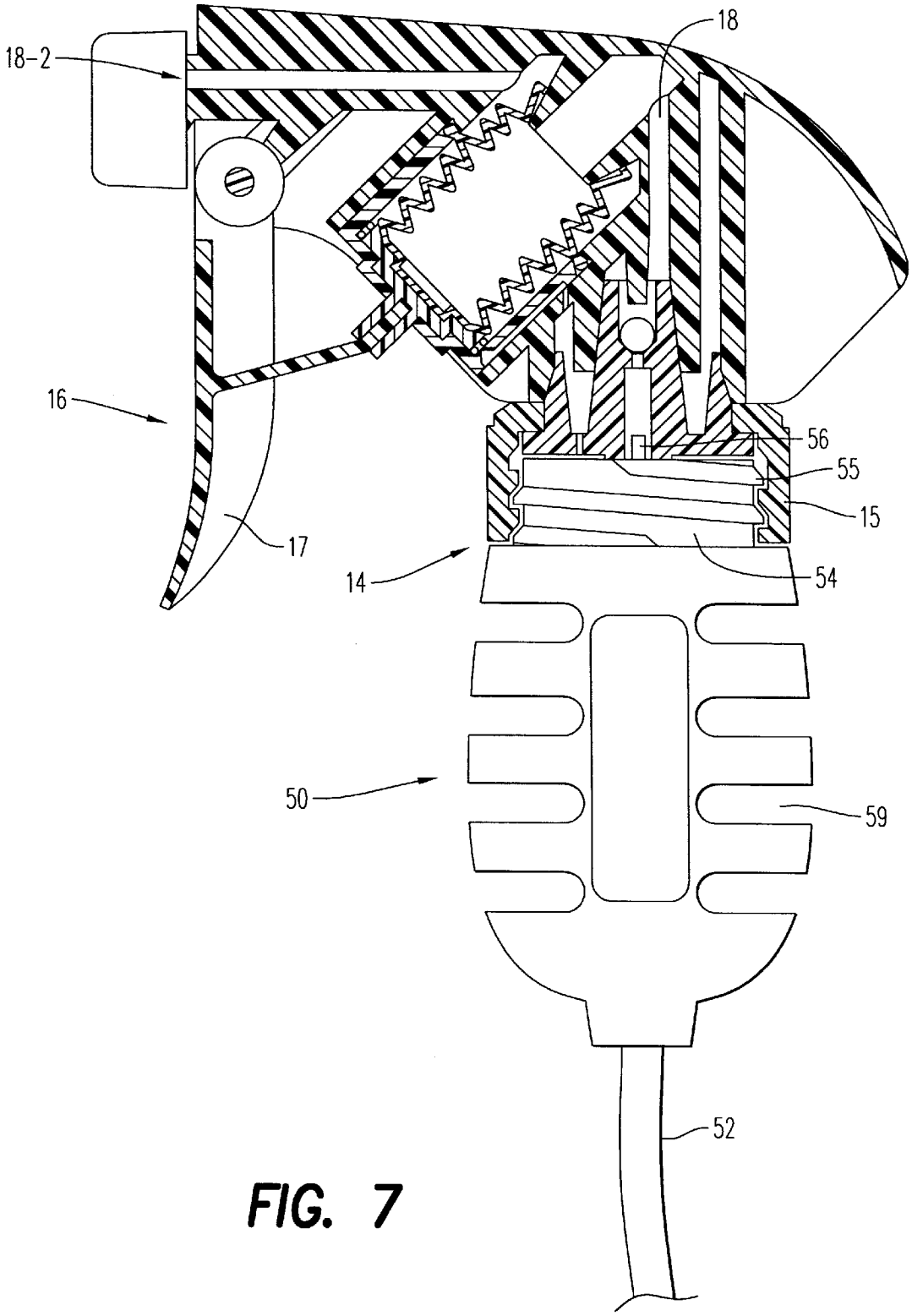
FIG. 7 is a sectional view showing the pump removably coupled to the pump extender.

Pump extender 50, shown in FIGS. 5 and 6, has an extension conduit 52 and a connecting end 54. In a preferred embodiment, extension conduit 52 is a coiled hose adapted to expand and contract. Connecting end 54 is configured to mimic open end 12-1 of container 12 and configured to mimic dip tube 22. Preferably, connecting end 54 includes a dip tube substitute 56 configured to mimic dip tube 22 and an externally threaded end 55 having a thread that corresponds to the thread of internally threaded cap 15. Shown in FIG. 7, extender 50 is removably connected to pump 10 so as to replace container 12. Accordingly, extender 50 places extension conduit 52 in fluid communication with output 18-2 of pump 10. For example, extender 50 is connected to pump 10 by coupling externally threaded end 55 and threaded cap 15 such that dip tube substitute 56 is sealably received by adapter 20.

In a preferred embodiment, extender 50 also includes a handgrip portion 58 that provides the assembly of pump 10 and the extender 50 with an ergonomic shape. Moreover, handgrip portion 58 preferably includes grippers 59 to increase the user's ability to hold extender 50.

Preferably, support 30 also includes one or more implement holders 35. Holders 35 are configured to hold common tools. Such tools include, but are not limited to, cleaning rags, scrappers, sponges, screw driver, multi-tools and even some communication devices, such as pagers or phones, note pads, pens and other things.

At least one of holders 35, namely holder 35-1 of FIG. 2, is configured to receive actuator 16 of pump 10. Thus, holder 35-1 holds pump 10 when not in use. In this embodiment, the user is able to support pump 10 and container 12 from themselves, allowing the user to maintain both hands free.

Figure 8A:
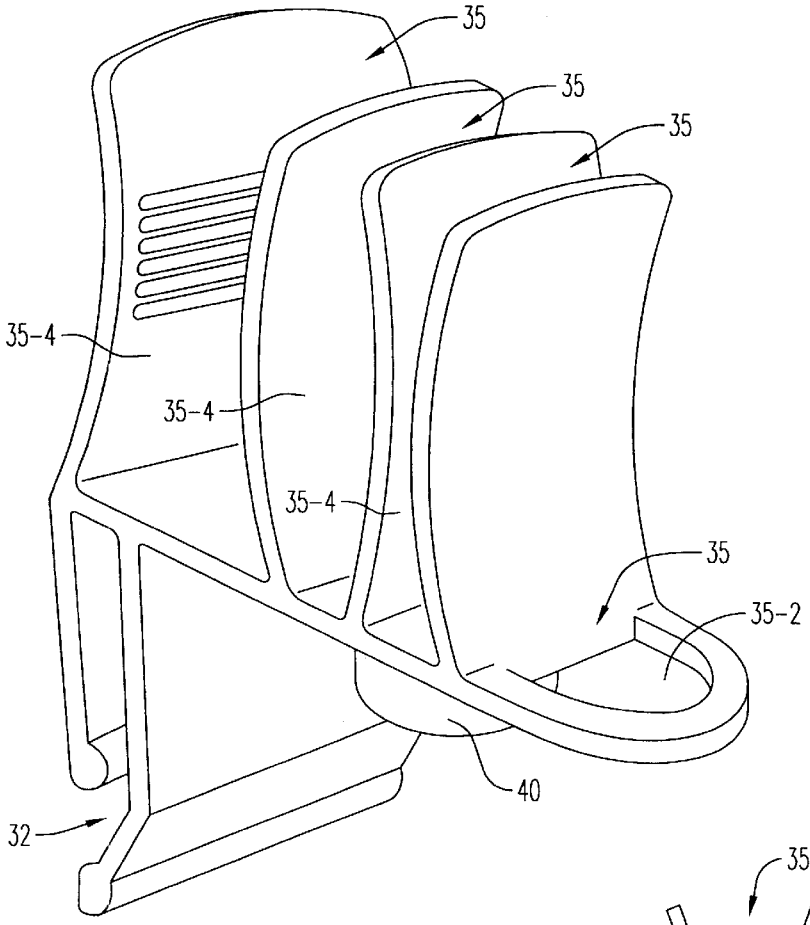
FIG. 8*a* is a perspective view of a second embodiment of the support of the present invention.
Figure 8B:
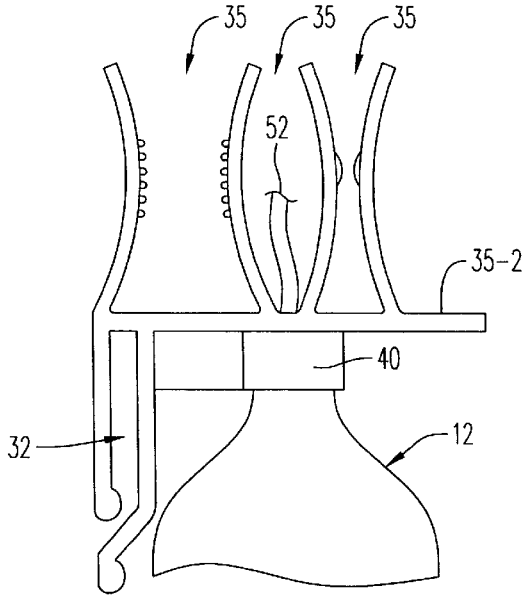
FIG. 8*b* is a side view of the support of FIG. 8*a* removably coupled to the container.

An alternate embodiment of support 30 is shown in FIGS. 8*a* and 8*b*. In this embodiment, holders 35 are configured as resiliently biased clips 35-4.

Figure 9A:
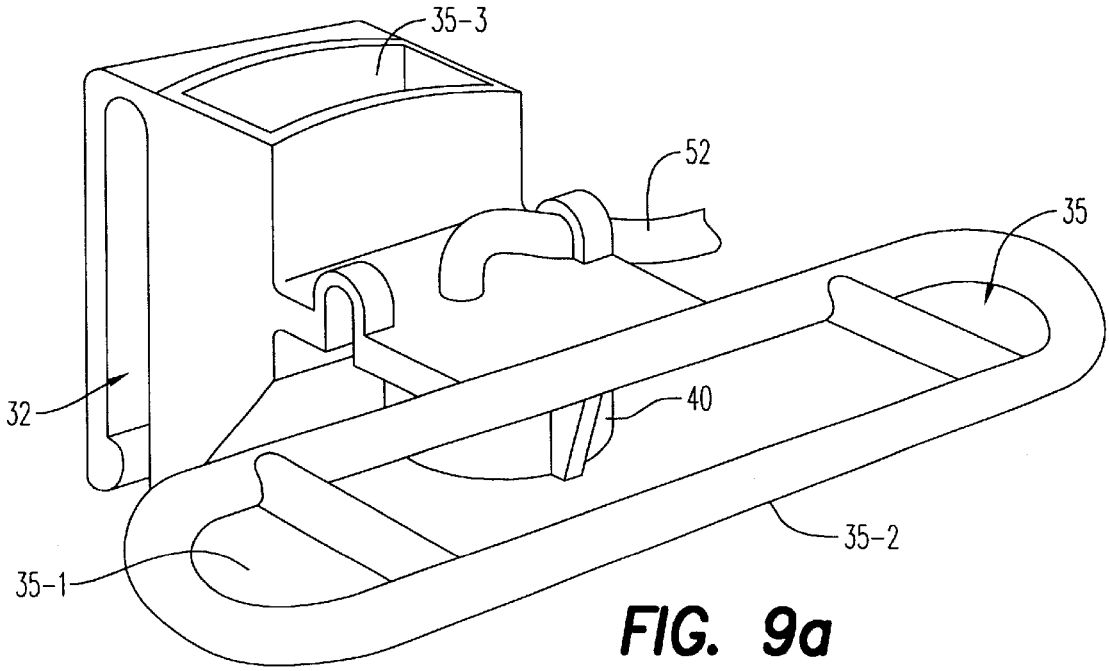
FIG. 9*a* is a perspective view of a third embodiment of the support of the present invention.
Figure 9B:
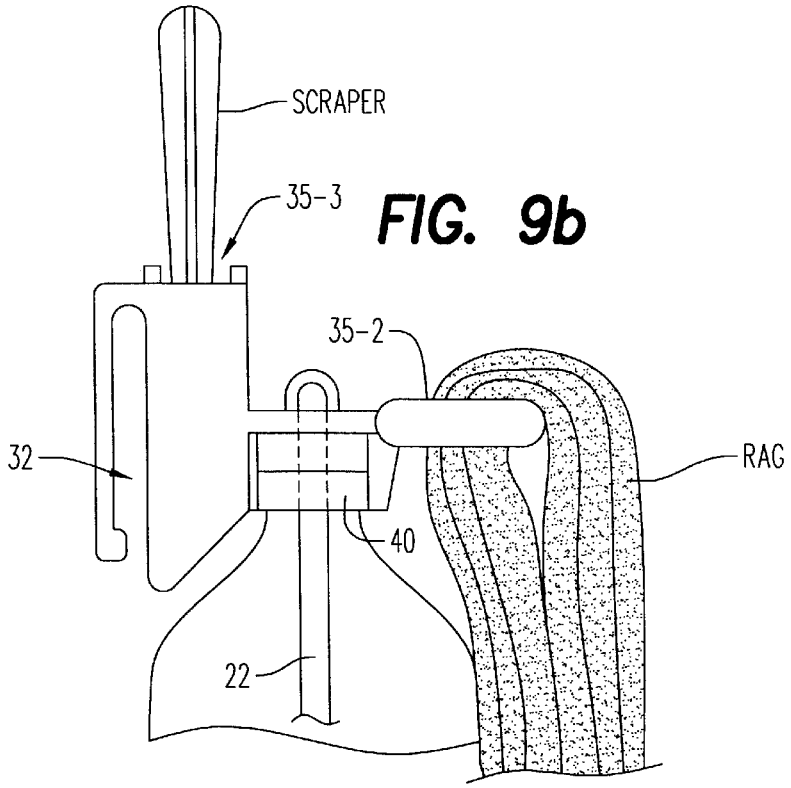
FIG. 9*b* is a side view of the support of FIG. 9*a* removably coupled to the container.

In the embodiment of support 30 of FIGS. 9*a* and 9*b*, at least one of holders 35, namely holder 35-2, is a rag bar configured to receive a rag. Thus, holder 35-2 holds the cleaner's rag when not in use. One of the benefits of the arrangement of FIG. 9 is that the rag, often dirty and wet, is held away from the user's clothing by the cooperation of holder 35-2 and container 12. Moreover, at least one of holders 35, namely holder 35-3, is a scrapper pocket configured to receive the sharp end of a scrapper. Thus, holder 35-3 holds the cleaner's scrapper when not in use in such a manner so as to present the handle to the scrapper to the user while shielding the sharp end. Holders 35, when formed as a pocket, should include at least one holed defined at the bottom of the pocket to ensure drainage of any liquid within the pocket.

Figure 10A:
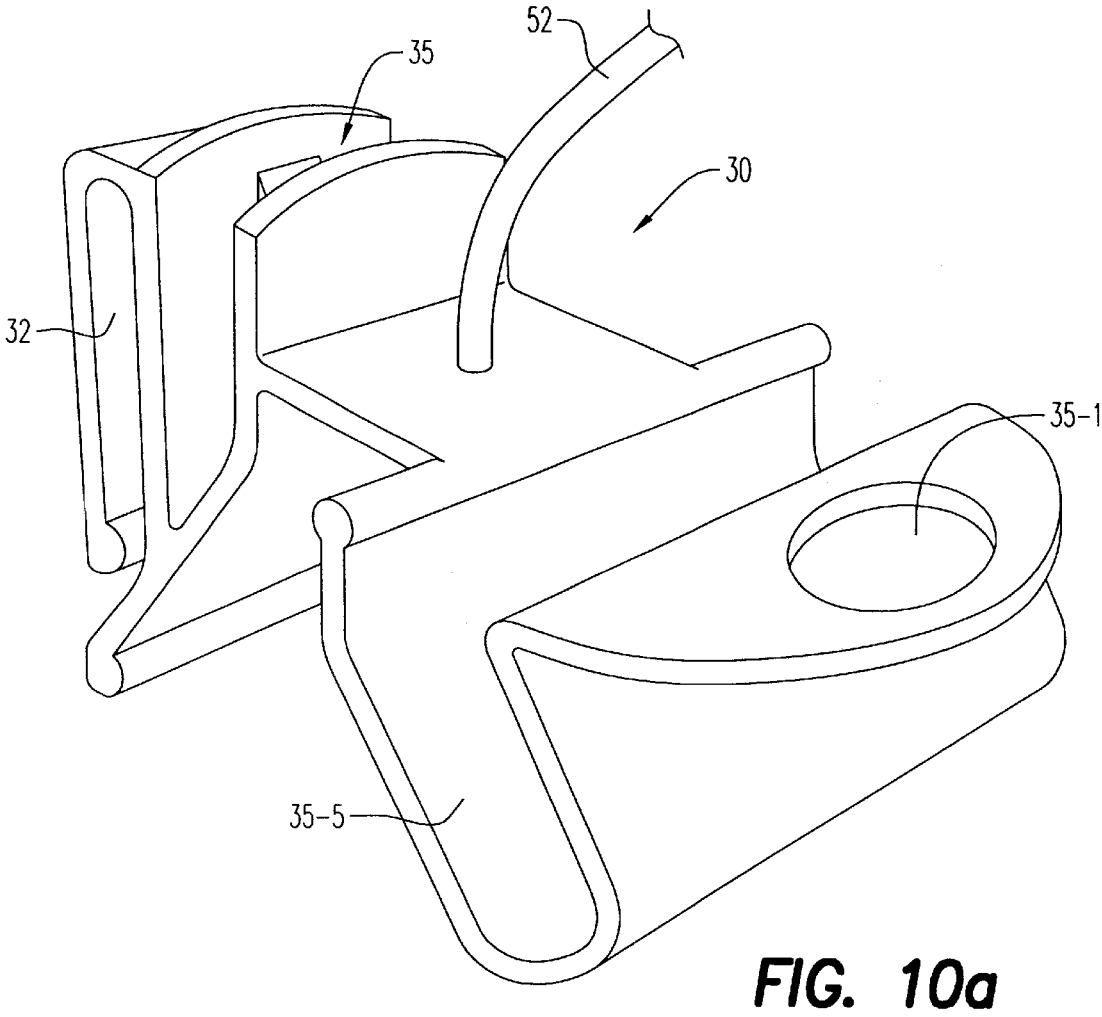
FIG. 10*a* is a perspective view of a fourth embodiment of the support of the present invention.
Figure 10B:
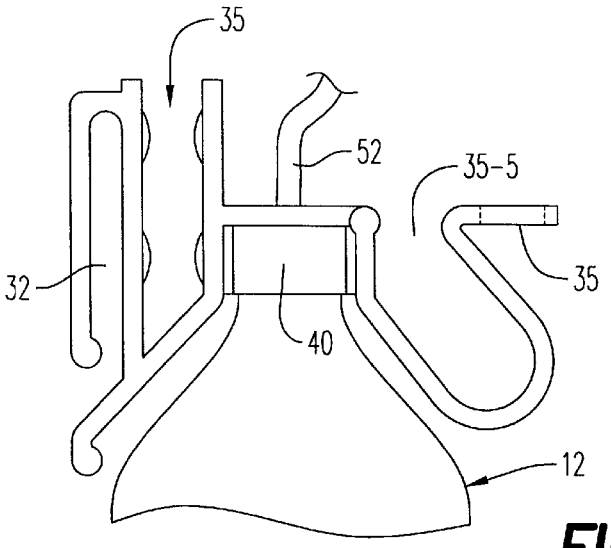
FIG. 10*b* is a side view of the support of FIG. 10*a* removably coupled to the container.
Figure 11A:
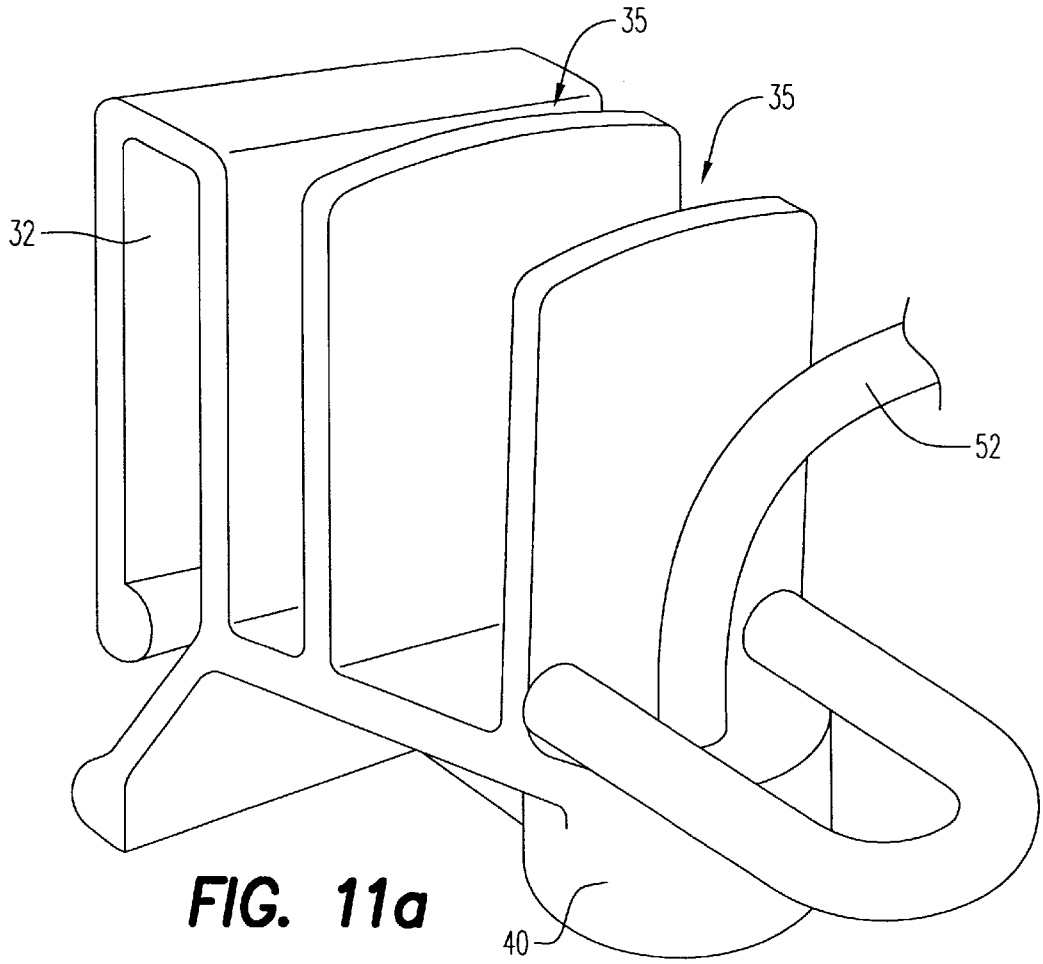
FIG. 11*a* is a perspective view of a fifth embodiment of the support of the present invention.
Figure 11B:
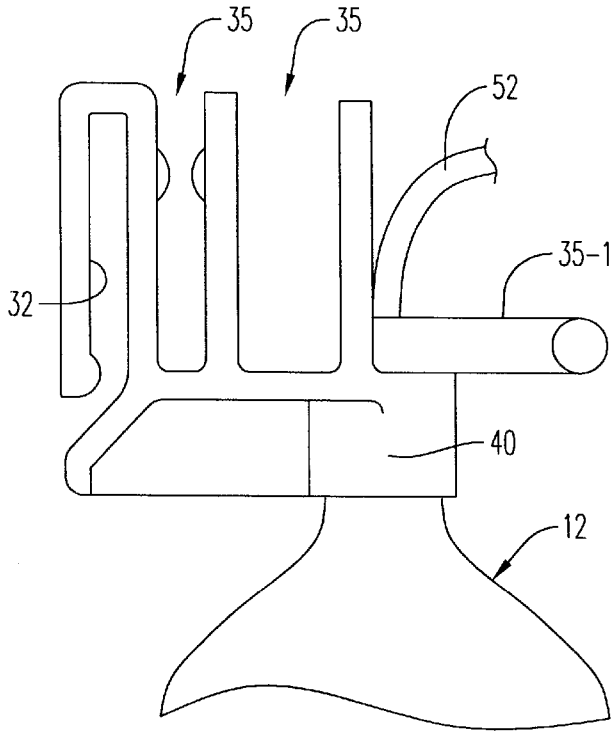
FIG. 11*b* is a side view of the support of FIG. 11*a* removably coupled to the container.

Another alternate embodiment of support 30 is shown in FIGS. 10*a* and 10*b*. In this embodiment, at least one of holders 35 is configured as an implement pocket 35-5. Yet another alternate embodiment of support 30 is shown in FIGS. 11*a* and 11*b*.

As an added safety feature, coupling 40 in an alternate embodiment is an internally threaded "safety or child proof" cap 42, such as those known in the art.

Figure 12A:
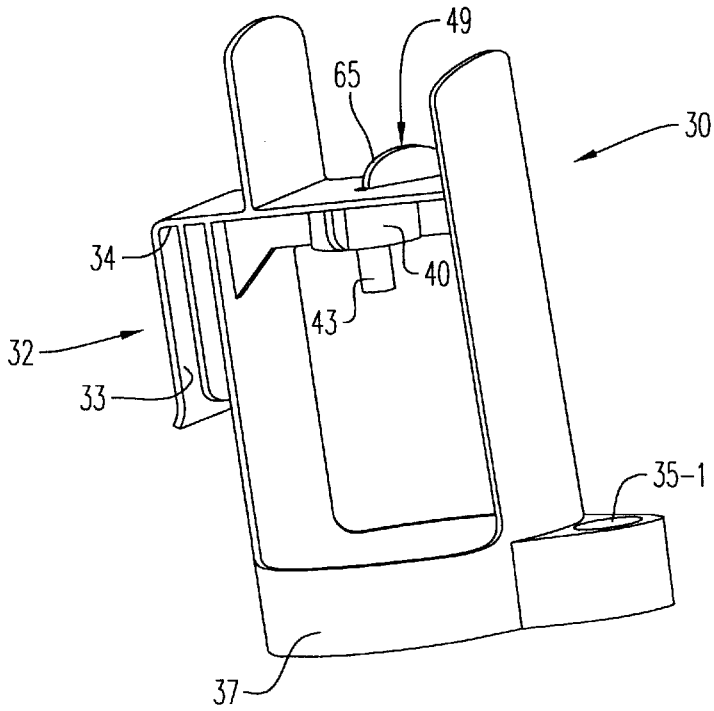
FIG. 12*a* is a perspective view of a sixth embodiment of the support of the present invention.
Figure 12B:
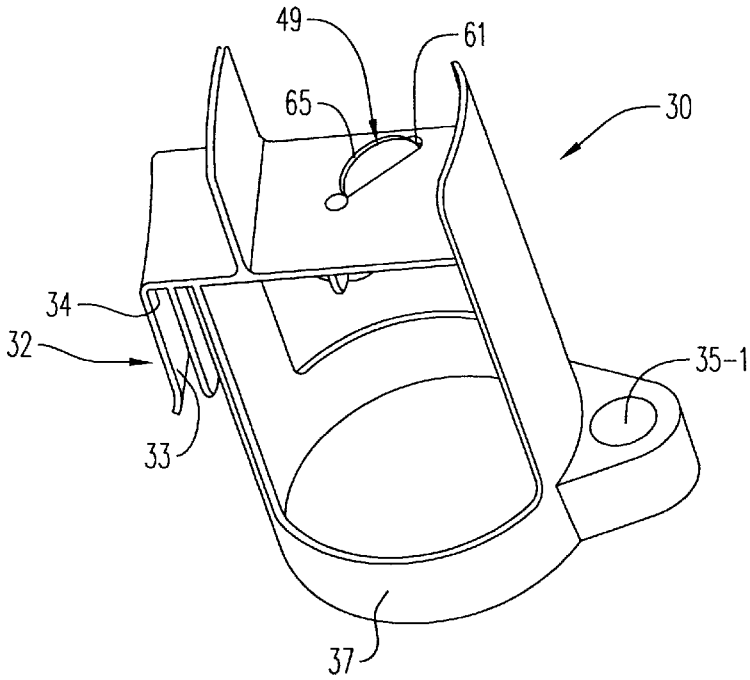
FIG. 12*b* is a second perspective view of the support of FIG. 12*a*.
Figure 12C:
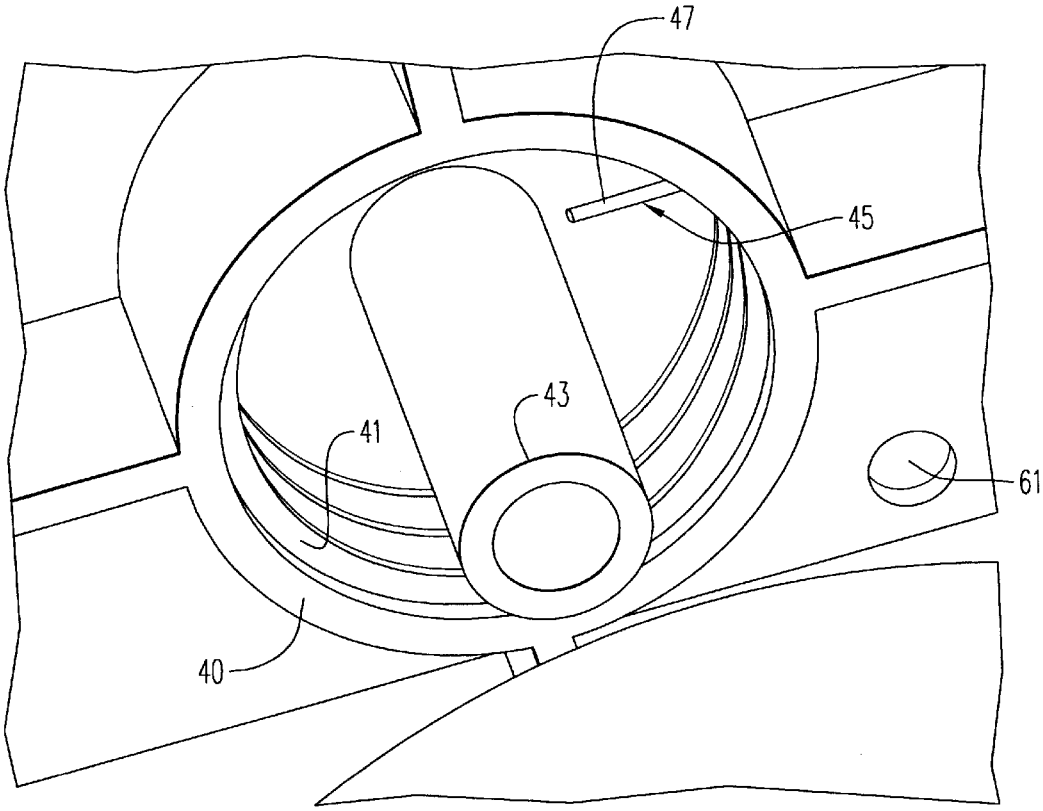
FIG. 12*c* is an end view of the support of FIG. 12*a*.

An alternate embodiment of support 30 is shown in FIGS. 12*a* through 12*c*. Support 30 includes bottle skirt 37 for supporting container 12 when coupled to container coupling 40. In a preferred embodiment shown in FIG. 12*b*, bottle skirt 37 extends circumferentially about container 12 and is vertically offset from coupling 40. Thus, bottle skirt 37 prevents external forces from uncoupling container coupling 40 and container 12.

As shown in FIG. 12*c*, container coupling 40 further includes a vent mechanism 45. Often, the removal of fluid from container 12 by pump 10 creates a vacuum within the container. The vacuum reduces the efficiency of pump 10. Thus, vent mechanism 45 is adapted to allow air into container 12 but prevent the leakage of liquid from the container. Preferably, vent mechanism 45 is a proturbance 47 and container coupling 40 is an internally threaded cap 41. Threading cap 41 to open end 12-1 of container 12 causes the open end to contact proturbance 47. Thus, proturbance 47 forms an air vent between cap 41 and open end 12-1. It should be understood that other vent mechanisms 45 that eliminate vacuum from within container 12 but prevent liquid from leaking from the container are within the scope of the present invention.

As shown in FIGS. 12*a* and *b*, container coupling 40 also includes a strain relief mechanism 49. Strain relief mechanism 49 is adapted to reduce the strain on the connection between extension conduit 52 and support 30 caused by the user. Preferably, strain relief mechanism 49 includes a hole 61, a hose barb (not shown) and an arcuate member 65. The end of extension conduit 52 opposite pump extender 50 is placed through hole 61 from the side of support 30 opposite arcuate member 65, wrapped over the arcuate member and coupled to the hose barb within adapter 43. Thus, adapter 43 places dip tube 22 within container 12 in fluid communication with extension conduit 52 and strain relief mechanism 49 aids in preventing the extension conduit from becoming disconnected from support 30. It should be understood that other strain relief mechanism 49 that reduce the strain on the connection between extension conduit 52 and support 30 caused by the user are within the scope of the present invention.

Figure 13:
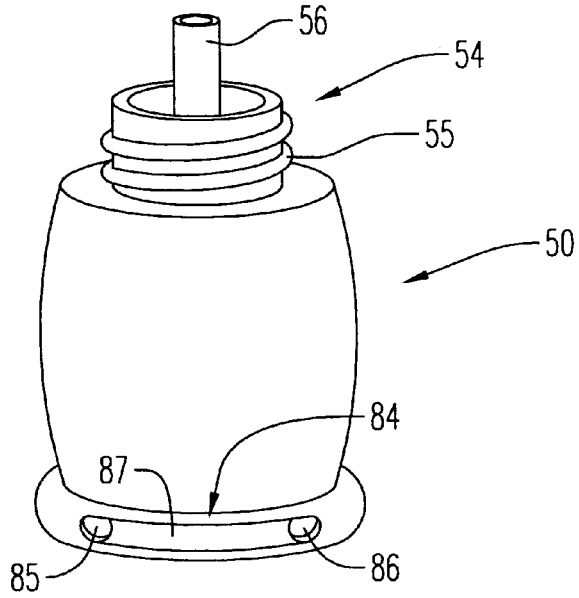
FIG. 13 is a perspective view of a third embodiment of the pump extender of the present invention.
Figure 14:
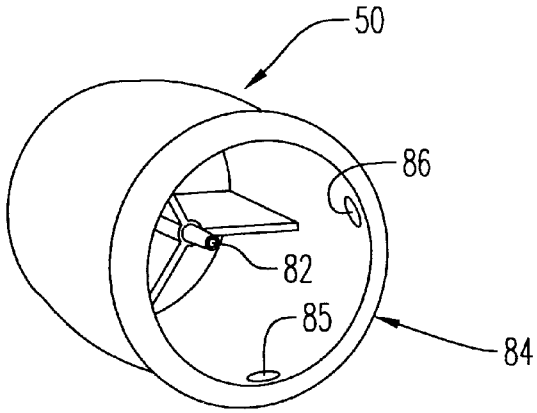
FIG. 14 is an end view of the pump extender of FIG. 13.

An alternate embodiment of pump extender 50 is shown in FIGS. 13 and 14. As described above, pump extender 50 has an extension conduit 52 and a connecting end 54. Connecting end 54 is configured to mimic open end 12-1 of container 12 and configured to mimic dip tube 22. Preferably, connecting end 54 includes a dip tube substitute 56 configured to mimic dip tube 22 and an externally threaded end 55 having a thread that corresponds to the thread of internally threaded cap 15. In the embodiment of FIGS. 13 and 14, extender 50 also includes a hose barb 82 and a strain relief mechanism 84. Hose barb 82 is adapted to receive the end of extension conduit 52 such that the extension conduit is in fluid communication with dip tube substitute 56. Strain relief mechanism 84, similar the strain relief mechanism 49 described above, is adapted to reduce the strain on the connection between extension conduit 52 and extender 50 caused by the user. Preferably, strain relief mechanism 84 includes a first hole 85, a second hole 86 and an arcuate member 87. The end of extension conduit 52 is placed through hole 85 from inside of extender 50, wrapped over arcuate member 87, placed through hole 86 to the inside of extender 50 and coupled to hose barb 82. While strain relief mechanism 84 has been described above by way of example, it should be understood that other strain relief mechanisms that reduce the strain on the connection between extension conduit 52 and extender 50 are within the scope of the present invention.

Accordingly, assembly 70 forms spray bottle 5 having pump 10 operatively coupled to container 12 via extension conduit 52. The user uses fastener 32 to connect support 30 to themselves to carry container 12 while extender 50 allows the user to spray liquid from within the container but maintain one hand free. Assembly 70 allows the user to support the weight of container from, for example, his or her pants waist, pockets or belt, thus, reducing fatigue and strain. Assembly 70 allows the user to support more than one assembly 70, thus reducing the need to go back and forth to get additional cleaning solutions. Assembly 70 allows the user to keep various tools and implements on hand. Moreover, assembly 70 allows the user to spray vertically or substantially vertically and allows the user to spray in hard to reach places where standard bottles are unable to reach.

It should be understood that the foregoing description is only illustrative of the present invention. Various alternatives and modifications can be devised by those skilled in the art without departing from the invention. Accordingly, the present invention is intended to embrace all such alternatives, modifications and variances that fall within the scope of the appended claims.

What is claimed is:

1. An assembly for use with a spray bottle having a container with an open end for being removably seated to a pump, wherein the assembly comprises:

a bottle support including a fastener, an internally threaded container coupling, and a bottle skirt vertically offset from the threaded container coupling;

a pump extender with a dip tube substitute and an externally threaded end adapted to be operatively connected to an internally threaded cap of a pump; and an extension conduit in fluid communication with the pump extender, wherein the fastener is securable to clothing of a user of the spray bottle, the container coupling is removably sealable to the open end of the container, the container coupling is operatively coupled to the extension conduit, and the vertically offset bottle skirt is offset from the container coupling of the bottle holder a sufficient distance to circumferentially surround a container to prevent external forces from uncoupling the container coupling from the container when the container coupling is coupled to the container.

2. The assembly of claim 1, wherein the fastener is a clip for securing the bottle support to the clothing of a user.

3. The assembly of claim 2, wherein the clip includes a resiliently biasing portion.

4. The assembly of claim 1, wherein the container coupling is an internally threaded cap.

5. The assembly of claim 4, wherein the internally threaded cap is a safety or child proof cap.

6. The assembly of claim 1, wherein the container coupling further comprises a vent mechanism.

7. The assembly of claim 1, wherein apparatus further comprises a dip tube operatively connected to the extension conduit for insertion into the container, which dip tube further includes an anti-siphon device operatively sealed thereto.

8. The assembly of claim 1, wherein the pump extender comprises a handgrip portion that provides the assembly with an ergonomic shape.

9. The assembly of claim 1, the pump extender comprises a plurality of grippers to increase the user's ability to hold the pump extender.

10. The assembly of claim 1, wherein the bottle support further comprises at least one implement holding means.

11. The assembly of claim 10, wherein the implement holding means comprises a holder for holding the pump.

12. An assembly for use with a spray bottle having a container with an open end for being removably sealed to a pump, wherein the assembly comprises:

a bottle support including a fastener, an internally threaded container coupling, a pump extender with a dip tube substitute and an externally threaded end adapted to be operatively connected to an internally threaded cap of a pump; and an extension conduit in fluid communication with the pump extender, wherein the fastener is securable to clothing of a user of the spray bottle, the container coupling is removably sealable to the open end of the container, the container coupling is operatively coupled to the extension conduit, and the pump extender further comprises a hose barb connecting to an end of the extension conduit, and a means for relieving strain on the connection between the extension conduit and the hose barb.

13. The assembly of claim 12 wherein the means for relieving strain comprises, at an end of the pump extender opposite the externally threaded connecting end, a first and a second hole and an arcuate member, and whereby said extension conduit passes through the first hole from inside the pump extender, passes over the arcuate member and through the second hole back to the inside of the pump extender and is connected to the hose barb.

* * * * *